US009658569B2

(12) United States Patent
Kayahara

(10) Patent No.: US 9,658,569 B2
(45) Date of Patent: May 23, 2017

(54) IMAGE FORMING APPARATUS WITH TONER REFILLING UNIT

(75) Inventor: Yasufumi Kayahara, Tokyo (JP)

(73) Assignee: CANON FINETECH INC., Misato-shi (JP)

( * ) Notice: Subject to any disclaimer, the term of this patent is extended or adjusted under 35 U.S.C. 154(b) by 56 days.

(21) Appl. No.: 12/974,068

(22) Filed: Dec. 21, 2010

(65) Prior Publication Data

US 2011/0158669 A1 Jun. 30, 2011

(30) Foreign Application Priority Data

Dec. 24, 2009 (JP) ..... 2009-293558
Dec. 14, 2010 (JP) ..... 2010-278254

(51) Int. Cl.
*G03G 15/08* (2006.01)

(52) U.S. Cl.
CPC ..... *G03G 15/0877* (2013.01); *G03G 15/0872* (2013.01); *G03G 15/0839* (2013.01)

(58) Field of Classification Search
CPC ..... G03G 15/0877; G03G 15/0865; G03G 15/0839
USPC ..... 399/27, 53, 258
See application file for complete search history.

(56) References Cited

U.S. PATENT DOCUMENTS 6,181,886 B1 * 1/2001 Hockey et al. ..... 399/35
7,398,038 B2 7/2008 Tsuda et al.
7,920,799 B2 4/2011 Wada et al.
7,949,265 B2 5/2011 Sakita et al.
2003/0219263 A1 * 11/2003 Tsuzuki ..... G03G 15/0856 399/27
2004/0151520 A1 * 8/2004 Phillips ..... G03G 15/0877 399/258
2005/0226656 A1 * 10/2005 Tsuda ..... G03G 15/0868 399/258
2007/0058996 A1 * 3/2007 Sakita et al. ..... 399/27
2008/0285986 A1 * 11/2008 Wada et al. ..... 399/27

FOREIGN PATENT DOCUMENTS

CN 101369123 A 2/2009
EP 0 583 634 A2 2/1994
JP 01186982 A * 7/1989
JP 2001341847 A 12/2001
JP 2005-84072 A 3/2005
JP 2006-78682 A 3/2006
JP 2006078682 A * 3/2006
JP 2006220984 A 8/2006
JP 2009251152 A 10/2009

OTHER PUBLICATIONS

Office Action dated Dec. 7, 2012, in Chinese Application No. 201010606063.3.
Chinese Office Action dated May 22, 2014, in related Chinese Patent Application No. 201310053205.1.

* cited by examiner

*Primary Examiner* — Erika J Villaluna
(74) *Attorney, Agent, or Firm* — Fitzpatrick, Cella, Harper & Scinto

(57) ABSTRACT

The present invention prevents a toner bottle from being erroneously determined to be empty and allows toner to be reliably refilled into a hopper and thus a developing unit in an image forming apparatus including the developing unit configured to develop an electrostatic latent image formed on an image carrier, using toner.

12 Claims, 11 Drawing Sheets

IMAGE FORMING APPARATUS WITH TONER REFILLING UNIT

BACKGROUND OF THE INVENTION

Field of the Invention

The present invention relates to an image forming apparatus such as an electrophotographic copier, and in particular, to an image forming apparatus in which toner is refilled via a replaceable toner bottle.

Description of the Related Art

In recent years, electrophotographic copiers and information recording apparatuses have been increasingly miniaturized. Thus, a plurality of developing units is provided in a limited space around an electrostatic latent image carrier or the size of a developing unit is reduced. As a result, the amount of toner housed in the developing unit is also reduced.

Thus, in some image forming apparatuses, developing unit is refilled with toner fed directly from a storage vessel (hereinafter referred to as a toner bottle) filled with the toner. In this configuration, the amount of toner discharged into the developing unit is not constant owing to the amount of toner remaining in the toner bottle. Hence, the rates of new toner and old toner in the developing unit may not be constant, resulting in degraded image quality.

In contrast, in other image forming apparatuses, a toner refilling unit (hopper) in which toner is temporarily stored is provided between the toner bottle and the developing unit. Thus, the developing unit is refilled with toner via the hopper. As a result, these image forming apparatuses can stably achieve the toner refilling.

The toner in the toner bottle is fed into the hopper based on the rotation of the toner bottle. The amount of toner fed into the hopper is controlled by rotating the toner bottle according to a detection output from a remaining amount detecting unit provided in the hopper. This makes the amount of toner in the hopper constant.

The toner fed into the hopper is conveyed to the developing unit by a screw provided in the hopper. The amount of toner conveyed is controlled based on the detection result from a toner remaining amount detecting sensor provided in the developing unit so that the developing unit can be refilled with toner as required. In this case, a stirring member provided in the hopper rotates in synchronism with a rotating shaft of the screw. This prevents the toner from being retained in the hopper.

The above-described operation is repeated to enable the developing unit to be stably refilled with toner from the toner bottle.

Japanese Patent Application Laid-Open No. 2005-084072 discloses a technique to refill a developing unit with toner from a hopper using a toner conveying mechanism so as to compensate for toner consumed by development. In this configuration, when a toner remaining amount detecting sensor in the hopper detects that no toner remains in the toner hopper, a toner bottle is rotated to refill the toner hopper with toner. When the toner remaining amount detecting sensor still detects that no toner remains in the hopper even after the toner bottle has been rotated, a control unit displays a request for replacement of the toner bottle and then starts counting the number of rotations of the toner conveying mechanism. When the count Value reaches a predetermined rotation number, the control unit displays a prior notice of deactivation of the print operation.

According to the above-described conventional technique, if the toner bottle is in an initial use state, a large amount of toner is discharged from the toner bottle and retained near an outlet of the toner bottle. The toner is continuously discharged from the toner bottle until the toner remaining amount detecting sensor provided in the hopper detects that "toner remains in the hopper". Thus, even though toner actually remains in the hopper, a long time elapses Until the toner remaining amount detecting sensor detects that "toner remains in the hopper". Consequently, the toner may overflow the hopper. Furthermore, if the toner bottle is inserted or removed in the above-described state, the inside of the apparatus or the user's hand or clothes may be stained with toner attached to the outlet of the toner bottle.

In contrast, if only a small amount of toner remains in the toner bottle, then even after the toner remaining amount detecting sensor in the hopper detects that no toner remains and the toner bottle is then rotated a predetermined number of times or for a predetermined time, the following may occur. Only a small amount of toner is discharged, and the toner remaining amount detecting sensor thus continues to detect that no toner remains in the hopper. Hence, the toner remaining amount detecting sensor erroneously detects that the toner bottle is empty even though toner actually remains in the toner bottle.

Here, the toner remaining amount detecting sensor provided in the hopper may be allowed to detect the toner in the hopper by actuating a stirring paddle to stir toner converging on one side of the hopper; the stirring paddle is provided in the hopper to allow the toner remaining amount detecting sensor to confirm that no toner remains in the hopper. However, in some recent products, the same driving source is used both for an auger in a conveying path through which a developing unit is refilled with toner and for the stirring paddle, in order to reduce the size and cost of the apparatus. In this case, when the stirring paddle is actuated to allow the toner to be detected, the auger is actuated even when this is unnecessary because of a sufficient amount of toner remaining in the developing unit. As a result, an excessive amount of toner may be fed into the developing unit.

The present invention is provided in view of the above-described circumstances. An object of the present invention is to provide an image forming apparatus configured to prevent the toner bottle from being erroneously determined to be empty and to allow toner to be more reliably refilled into the hopper and thus the developing unit.

SUMMARY OF THE INVENTION

An image forming apparatus according to the present invention includes a developing unit configured to develop an electrostatic latent image formed on an image carrier, using toner, and further includes a toner bottle housing unit in Which a toner bottle is removably housed, a hopper in which toner fed from the housed toner bottle is stored, a conveying unit for conveying toner from the hopper to the developing unit, a stirring member provided in the hopper to stir inside of the hopper while the conveying unit is conveying the toner, a toner-in-hopper detecting unit for determining whether or not toner remains in the hopper, a toner refilling unit for rotating the toner bottle by a unit amount to refill the hopper with the toner from the toner bottle when the toner-in-hopper detecting unit detects that no toner remains in the hopper, a counting unit for counting the number of toner refilling operations executed by rotating the toner bottle by the unit amount after the toner-in-hopper detecting unit has detected that no toner remains in the hopper, and a control unit for driving the stirring member by driving the conveying unit when the number of executions reaches a predetermined threshold, and determining that no toner remains in the toner bottle when the toner-in-hopper detecting unit still detects that no toner remains in the hopper, even after the stirring member has been driven, the control unit clearing the counted number of executions when the toner-in-hopper detecting unit detects that toner remains in the hopper before the number of executions reaches the predetermined threshold or after the stirring member has been driven.

If no toner is detected in the hopper in spite of the toner refilling operation performed by rotating the toner bottle by the unit amount after the toner-in-hopper detecting unit has detected that no toner remains in the hopper, the rotation of the toner bottle by the unit amount is repeated. In this case, the number of executions reaching the predetermined threshold means the reduced amount of toner remaining in the toner bottle. When the number of executions reaches the predetermined threshold, the apparatus drives the conveying unit and thus the stirring member instead of immediately determining that no toner remains in the toner bottle. Even after the stirring member has been driven, the apparatus determines that no toner remains in the toner bottle when the toner-in-hopper detecting unit detects that no toner remains in the hopper. That is, when the toner in the hopper converges in the vicinity of an outlet of the toner bottle, the apparatus may determine that no toner remains in the hopper even though toner actually remains in the hopper. Such erroneous detection of emptiness is avoided by driving the stirring member to allow the toner-in-hopper detecting unit to detect the toner.

The control unit can variably set the predetermined threshold based on an accumulated value obtained by accumulating the number of executions after replacement of the toner bottle. For example an increase in accumulated value means a decrease in the amount of toner remaining in the toner bottle. Thus, an increase in accumulated value reduces the amount of toner discharged from the toner bottle based on the rotation of the toner bottle by the unit amount. To compensate for this, the threshold is increased in a stepwise fashion consistently with the accumulated value. Then, the number of operations of refilling the hopper with toner from the toner bottle is increased when the toner-in-hopper detecting unit detects that no toner remains in the hopper. This reduces the possibility that the apparatus determines that no toner remains in the hopper in spite of driving of a hopper motor, compared to the case in which the threshold is not increased.

The image forming apparatus according to the present invention may further include an amount-of-toner-in-developing-unit detecting unit for detecting the amount of toner in the developing unit. In this case, the control unit checks an output from the amount-of-toner-in-developing-unit detecting unit when the number of executions reaches the predetermined threshold. The control unit then inhibits the conveying unit from being driven when the output is equal to or larger than a predetermined value. Thus allows toner to be inhibited from being conveyed when the amount of toner in the developing unit exceeds a predetermined value. As a result, the developing unit is prevented from being refilled with an excessive amount of toner.

The predetermined threshold may include at least a first threshold and a second threshold. The control unit may determine the amount of toner remaining in the toner bottle in a plurality of stages based on the value of the number of executions obtained when the toner-in-hopper detecting unit detects toner in the hopper as a result of driving of the conveying unit after the toner-in-hopper detecting unit has detected no toner in the hopper. Thus, even when a toner bottle with no CRUM (Customer Replace Unit Memory: nonvolatile memory) mounted therein is used, the varying amount of toner remaining in the toner bottle (the interim amount of remaining toner) can be estimated.

The time for which the conveying unit is driven according to each of at least the first and second thresholds may be varied depending on the magnitude of the threshold. The larger threshold is expected to reduce the amount of toner discharged from the toner bottle. Thus, the possibility of successfully detecting that toner remains in the hopper can be enhanced by increasing the time for which the hopper motor is driven, that is, the time for stirring.

The apparatus may further include a unit configured to detect that the toner bottle has been replaced. In this case, the control unit drives the conveying unit when the hopper is refilled with toner by at least the first rotation of the toner bottle by the unit amount after the replacement Of the toner bottle. It is expected that a large amount of toner remains in the toner bottle after the replacement of the toner bottle, causing a significantly large amount of toner to be discharged from the toner bottle during the first rotation of the toner bottle by the unit amount. Even in such a case, the toner in the hopper can be evenly leveled by driving the conveying unit. This avoids smudging the inside of the apparatus with toner, enabling the user's hand or clothes to be prevented from being stained when the toner bottle is replaced.

The present invention prevents the toner bottle from being erroneously determined to be empty, thus reducing the amount of toner remaining in the tone bottle when the apparatus shows that the toner bottle is empty. The present invention also enables the user to be notified of the amount of toner remaining in the toner bottle without the need to newly provide an additional detecting unit.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
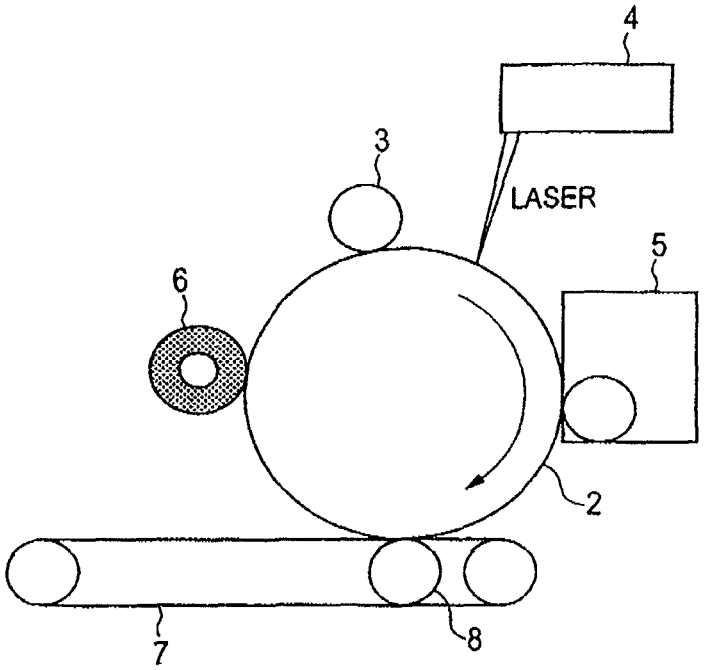
FIG. 1 is a diagram schematically illustrating the configuration of an electrophotographic image forming apparatus according to an embodiment of the present invention.

FIG. 1 schematically illustrates the configuration of an electrophotographic image forming apparatus according to the present exemplary embodiment. The image forming apparatus includes a photosensitive drum (image carrier) 2 configured to rotate in the direction of an arrow illustrated in FIG. 1, and in its periphery, charging member 3 configured to charge the photosensitive drum 2 to a predetermined potential, an image writer 4 such as a laser scanner which is configured to write an electrostatic latent image to the photosensitive drum 2, a developing unit 5 configured to visualize the electrostatic latent image formed on the photosensitive drum 2 using toner, a cleaner 6 configured to remove toner located on the surface of the photosensitive drum 2 and not transferred, and a transfer unit. The transfer unit includes a transfer belt 7 on which a transfer material is conveyed, and a transfer roller 8 configured to transfer a developed image developed by the developing unit 5 to the transfer material.

An image forming process carried out by the image forming apparatus will be described. First, the apparatus allows the charging member 3 to uniformly charge the photosensitive drum 2. Then, laser light from the image writer 4 is used to write an electrostatic latent image to the photosensitive drum 2. Thereafter, the apparatus allows the developing unit 5 to visualize the electrostatic latent image as a toner image. The apparatus then migrates the toner image to a transfer area at a predetermined timing. On the other hand, the transfer material is conveyed on the transfer belt 7 to the transfer area at a predetermined timing. Then, the transfer roller 8 and the charged transfer belt 7 apply a transfer bias to the transfer material to allow the toner image on the photosensitive drum 2 to be transferred to the transfer material. The transfer unit including the transfer belt 7 and the transfer roller 8 applies a transfer field to the transfer material so that the transfer material has a polarity reverse to that of charge provided by the charging member 3.

Figure 2A:
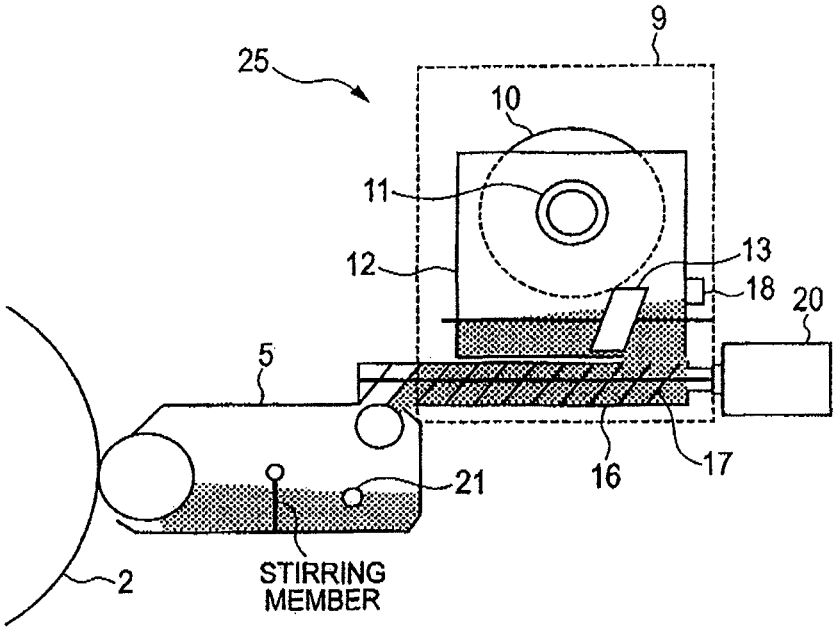
FIGS. 2A and 2B are partly enlarged views of a toner supply mechanism configured to supply toner to a developing unit illustrated in FIG. 1.
Figure 2B:
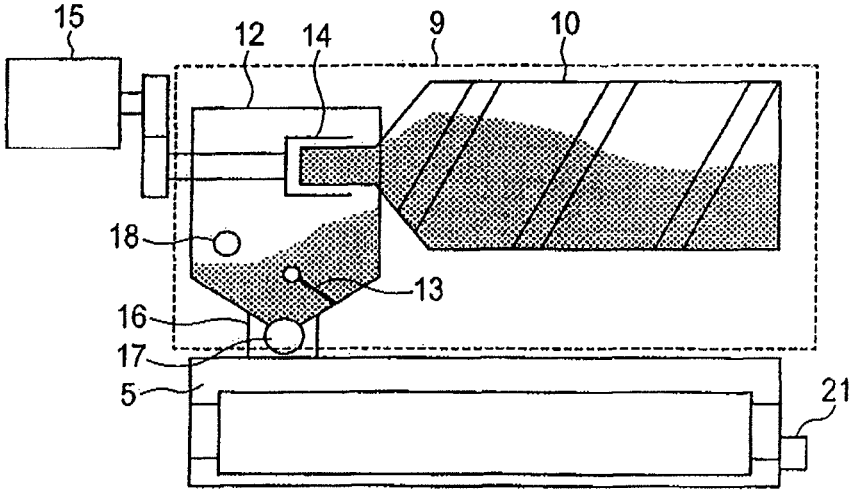

FIGS. 2A and 2B are partly enlarged views illustrating a toner supply mechanism configured to supply toner to the developing unit 5 located opposite the photosensitive drum 2. FIG. 2A is a front view, and FIG. 2B is a side view.

As illustrated in FIGS. 2A and 2B, a toner supply mechanism 25 includes a bottle housing unit (toner bottle housing unit) 9 in which the toner bottle 10 is removably housed, and a hopper 12 in which toner fed from the toner bottle 10 is temporarily stored. The toner bottle 10 and the hopper 12 are connected together by inserting an outlet 11 of the toner bottle into the hopper 12 so that the outlet 11 is coupled to a bottle coupling unit 14 of the hopper 12. A spiral projection is provided on the inner wall of the toner bottle 10. When the toner supply mechanism 25 rotates the toner bottle 10, the projection and the gravity allow the toner in the toner bottle 10 to be fed to the outlet 11 and then into the hopper 12. As illustrated in FIG. 2B, a bottle motor 15 is connected to the bottle coupling unit 14. The bottle motor 15 is rotated to rotate the bottle coupling unit 14 to feed the toner through the outlet 11 to the hopper 12. This configuration allows a toner refilling unit to be implemented. Furthermore, the hopper 12 and the developing unit 5 are connected together via a conveying path 16. The toner in the hopper 12 is fed to the developing unit 5 through an opening formed at the lower end of the hopper 12 via the conveying path 16. When a stirring paddle 13 provided in the hopper 12 so as to serve as a stirring member is rotated, migration of the toner in the hopper 12 to the conveying path 16 is facilitated. An auger (screw) 17 serving as a conveying unit is located in the conveying path 16 so that the toner in the conveying path 16 can be conveyed to the developing unit 5 by means of rotation of the hopper motor 20.

In the present exemplary embodiment, a toner sensor 18 (toner-in-hopper detecting unit) provided in the hopper 12 detects the amount of toner in the hopper 12 to indirectly detect the amount of toner remaining in the toner bottle 10.

Figure 3:
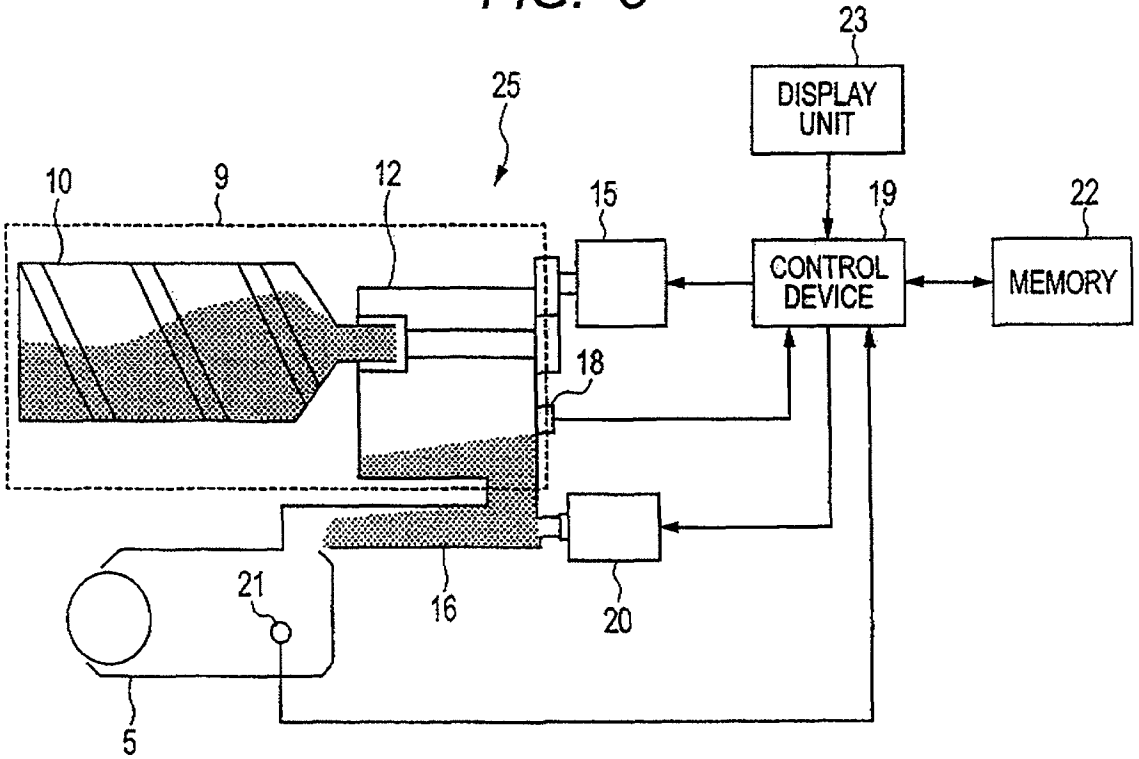
FIG. 3 is a diagram illustrating the toner supply mechanism illustrated in FIGS. 2A and 2B together with control hardware therefor.

FIG. 3 illustrates the toner supply mechanism 25 together with control hardware therefor.

The bottle motor 15 is connected to a control device 19 in the image forming apparatus main body. The control device 19 includes a processing device such as CPU. The control device 19 reads and executes any of control programs stored in a memory 22 to implement the required process. When requested to refill toner according to a detection result from the toner sensor 18, the control device 19 controls the bottle motor 15 so that the toner bottle 10 is subjected to repeated operations corresponding to required cycles each including rotational driving for a specified time (in the present example, 3 seconds) and stoppage for a specified time (in the present example, 2 seconds). The cycles may be specified in units of rotation number instead of time.

For example, the toner sensor 18 periodically determines whether or not toner remains in the hopper 12. A signal from the toner sensor 18 is constantly output to the control device 19. (In the present exemplary embodiment, the toner sensor 18 determines whether or not toner remains in the hopper 12, only during image formation.) If the signal from the toner sensor 18 indicates that no toner remains in the hopper, the control device 19 determines that the toner in the hopper 12 is likely to be exhausted. The control device 19 thus outputs a signal instructing the bottle motor 15 to perform one cycle operation. Thus, the above-described cycle is repeatedly carried out until toner is fed from the toner bottle 10 to the hopper 12, with resultant detection of the toner by the toner sensor 18. At this time, the number of cycles is counted and stored in the memory 22. When the toner sensor 18 detects toner, the count value is cleared.

As described above, when the developing unit 5 is refilled with toner, the toner is fed to the auger 17 in the conveying path 16. When the detection result from the toner sensor 21 provided in the developing unit 5 becomes smaller than a specified value, the hopper motor 20 is driven in response to an instruction from the control device 19. Thus, the developing unit 5 is refilled with toner. The stirring paddle 13 provided in the hopper 12 is rotated by the hopper motor 20 to stir the toner in the hopper 12 while the auger (17 in FIGS. 2A and 2B) in the conveying path 16, serving as a conveying unit, is being driven; the hopper motor 20 is also used to drive the auger 17 in the conveying path 16.

Figure 4:
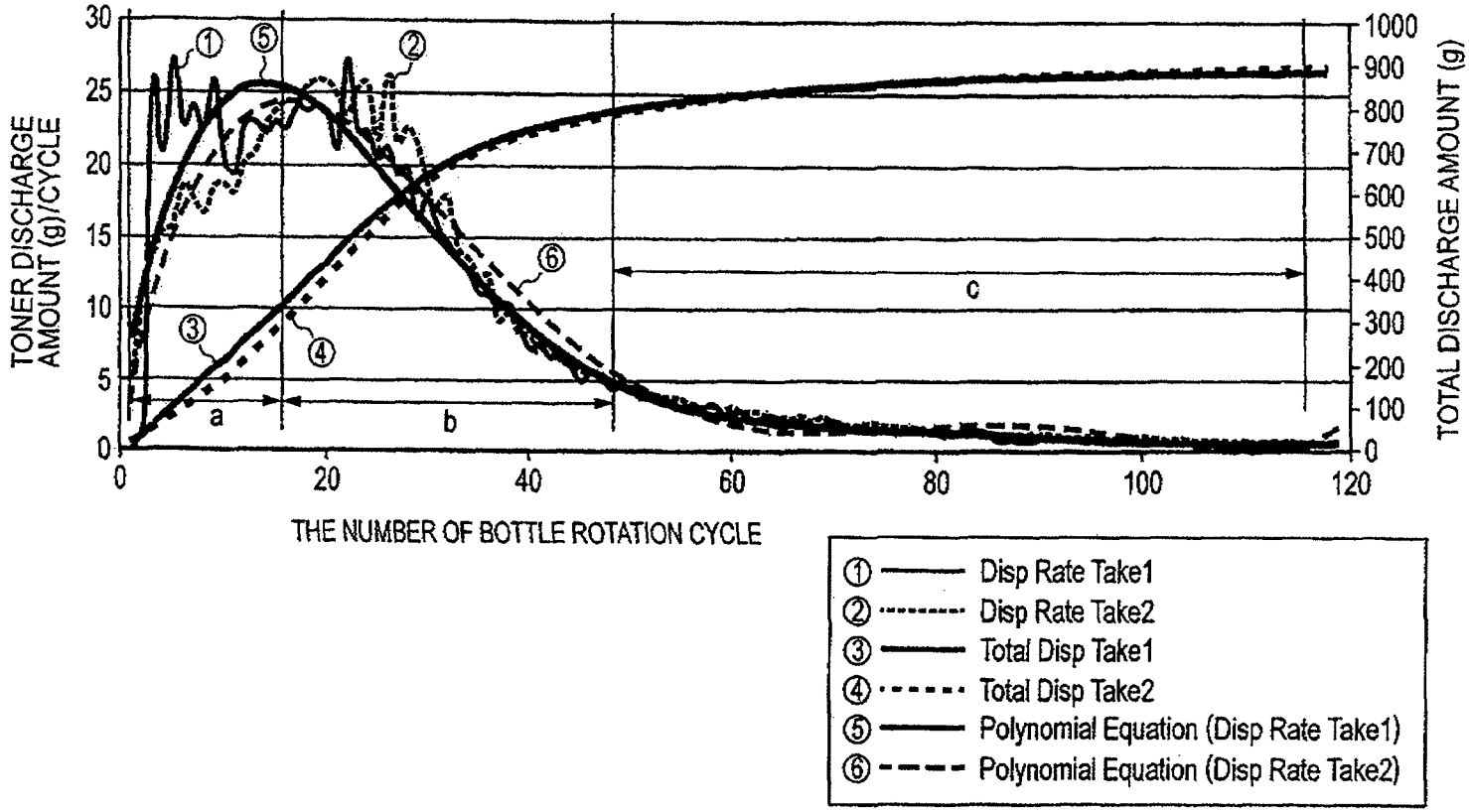
FIG. 4 is a graph illustrating the results of measurement of the relationship between the number of rotation cycles of a toner bottle used in an exemplary embodiment of the present invention and a toner discharge amount.

FIG. 4 is a graph illustrating the results of measurement of the relationship between the number of rotation cycles of the toner bottle 10 used in the present exemplary embodiment and a toner discharge amount. The axis of abscissas indicates the number of bottle rotation cycles. The axis of ordinate on the left of FIG. 4 indicates the toner discharge amount (g) per cycle. The axis of ordinate on the right of FIG. 4 indicates the total discharge amount (g). Graphs (1) and (2) in FIG. 4 illustrate the results of measurement of the toner discharge amount per cycle. Graphs (5) and (6) illustrate curves obtained by approximating the graphs (1) and (2), respectively, using polynomial equations. Graphs (3) and (4) illustrate the total discharge amount. Furthermore, the solid-line graphs (1), (3) and (5) illustrate measurement results for the case where the toner in the toner bottle converges near an inlet of the toner bottle (Take1). The dashed-line graphs (2), (4) and (6) illustrate measurement results for the case where the toner in the toner bottle converges near the bottom of the toner bottle (Take2).

Because of the convergence of the toner, there is a difference in toner discharge amount per cycle between the graphs (1) and (2) in the initial state (area (a)) following replacement of the toner bottle. However, the graphs (1) and (2) are generally approximated by the graphs (5) and (6). The graphs (5) and (6) indicate that in the initial state (area (a)), in which a large amount of toner is filled in the toner bottle 10, a large amount of toner is discharged from the toner bottle 10 per cycle. After the peak, the discharge amount decreases gradually (area (b)). A further decrease in the amount of toner in the toner bottle significantly reduces the toner discharge amount (area (c)).

To which of the areas (a), (b) and (c) on the elapsed time the amount of toner remaining in the toner bottle corresponds can be estimated by recording the accumulated number (accumulated value) of rotation cycles of the toner bottle 10 in the nonvolatile memory mounted on the toner bottle 10 and called CRUM.

Figure 5:
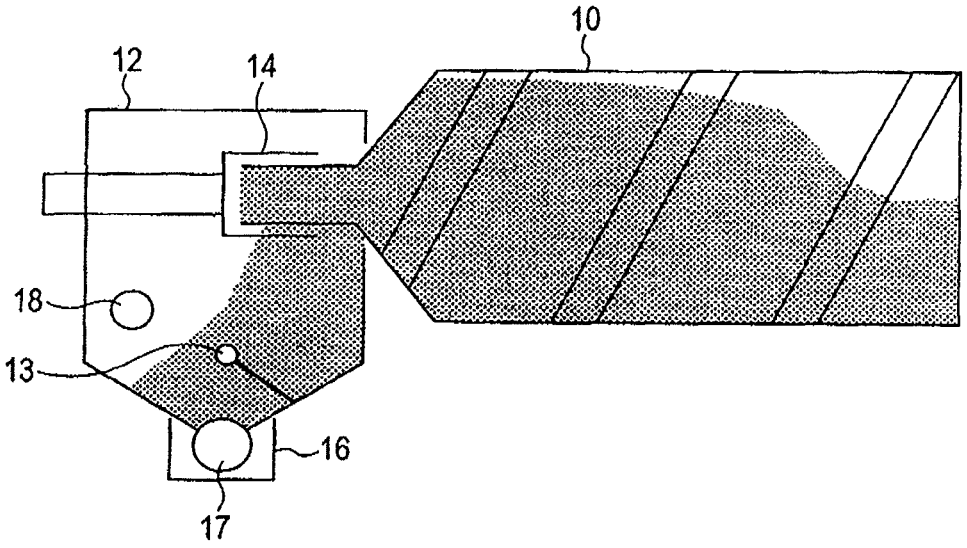
FIG. 5 is a diagram illustrating toner in the toner bottle and in a hopper in an area (a) in FIG. 4 corresponding to the number of toner bottle rotation cycles according to the exemplary embodiment of the present invention.
Figure 6:
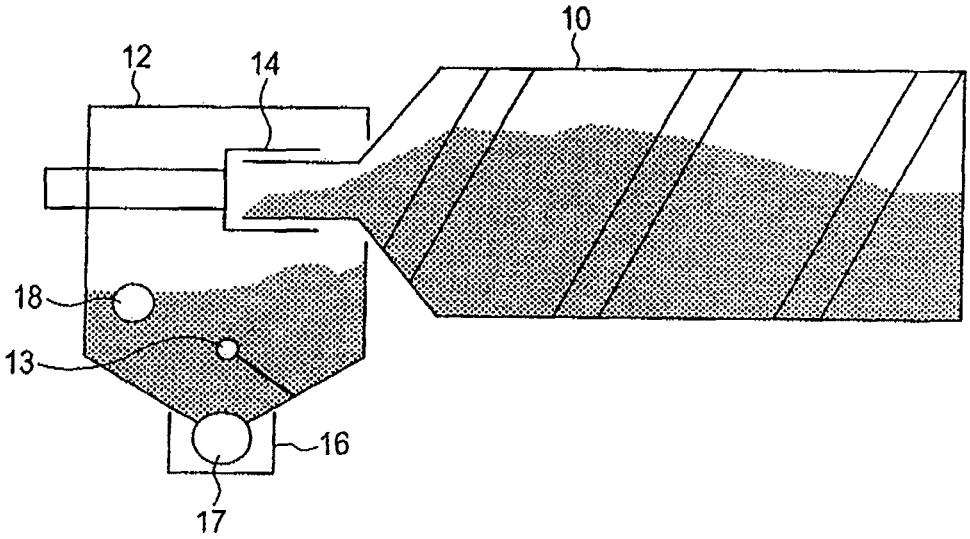
FIG. 6 is a diagram illustrating the toner in the toner bottle and in a hopper in an area (b) in FIG. 4 corresponding to the number of toner bottle rotation cycles according to the exemplary embodiment of the present invention.
Figure 7:
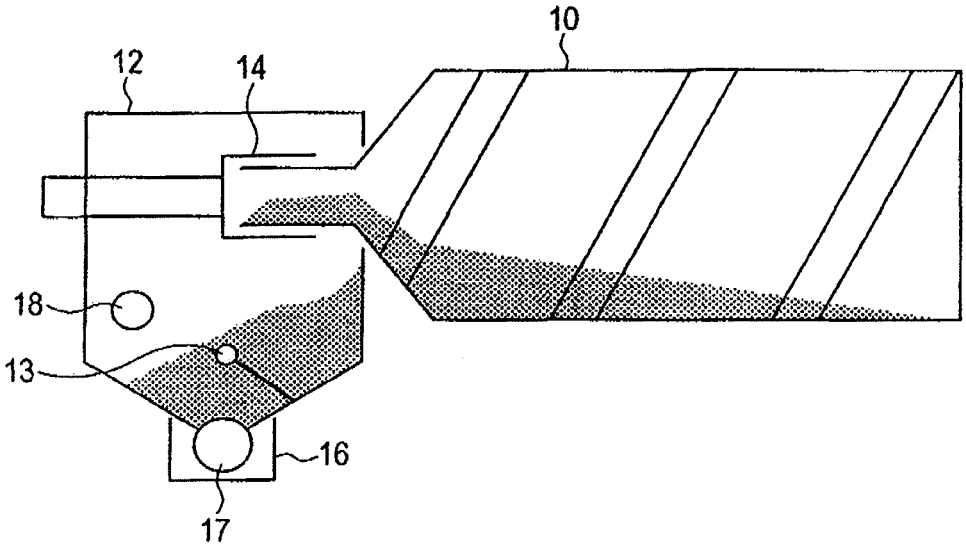
FIG. 7 is a diagram illustrating the toner in the toner bottle and in a hopper in an area (c) in FIG. 4 corresponding to the number of toner bottle rotation cycles according to the exemplary embodiment of the present invention.

FIG. 5, FIG. 6 and FIG. 7 illustrate the toner in the toner bottle 10 and in the hopper 12 in the areas (a), (b) and (c) corresponding to the number of rotation cycles of the toner bottle.

Figure 8:
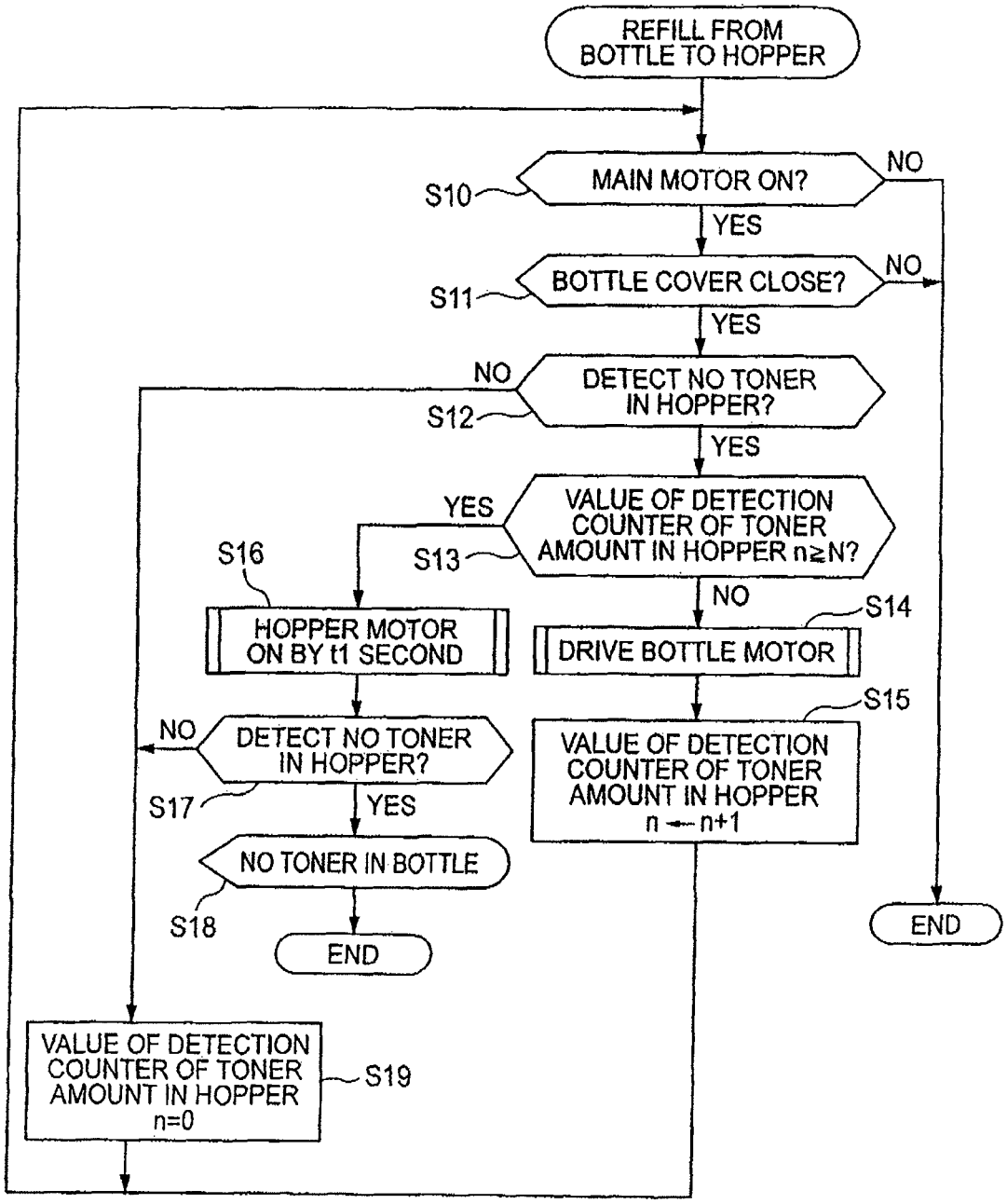
FIG. 8 is a flowchart illustrating a first process example of toner remaining amount control according to the exemplary embodiment of the present invention.

Now, a first process example of toner remaining amount control performed when the hopper is refilled with toner from the toner bottle will be described with reference to the flowchart illustrated in FIG. 8.

This control is performed when a main motor configured to drive the photosensitive drum 2 in the image forming apparatus is in a driving state (the main motor is on) (S10, Yes) and when a toner bottle cover (not illustrated in the drawings) is closed (S11, Yes). (Whether the toner bottle cover is open or closed is determined by an open-close detecting sensor (not illustrated in the drawings).)

First, the apparatus confirms that the toner sensor 18 in the hopper 12 (that is, the intra-hopper sensor) has detected that no toner remains (S12, Yes), and then carries out the following process.

When the above-described conditions are met, a value (n) in a hopper remaining amount detection counter is compared with a preset threshold N (S13). The "hopper remaining amount detection counter" is a unit configured to count, in step S12, the number of times that the toner sensor 18 has detected that no toner remains in the hopper. As described below, incrementation in the counter involves driving by the bottle motor. Thus, the hopper remaining amount detection counter value is equivalent to the number of times that the bottle motor has been driven, that is, the number of times that the toner refilling operation (cycle) has been performed by rotating the toner bottle by a unit amount. The counter value (n) is stored in the memory 22 in the image forming apparatus 1. The initial value of (n) is 0. The actual counter configured to actually perform counting operations may be implemented by hardware or by software.

If the count in the hopper remaining amount detection counter (n) is smaller than the preset threshold N (S13, No), the control device 19 (FIG. 3) rotates the bottle motor 15 by one cycle (that is, for a predetermined time or by a predetermined rotation number) corresponding to the unit amount to refill the hopper 12 with toner from the toner bottle 10 (S14). The threshold N is a preset constant and is 18 according to the present exemplary embodiment. Then, the count in the hopper remaining amount detection counter (n) is incremented (by one) (S15). Furthermore, if the CRUM is mounted in the toner bottle, the accumulated number of rotation cycles recorded in the CRUM is updated. (This also applies to incrementation in the "hopper remaining amount detection counter" in another process described below.) Thereafter, the process returns to step S10.

In step S13, if the count in the hopper remaining amount detection counter is equal to or larger than N (S13, Yes), the hopper motor 20 is driven for a pre-specified time t1 (for example, 3 seconds, that is, one cycle) to rotate the stirring paddle 13 in the hopper 12. Thus, the toner in the hopper 12 is evenly leveled. Hence, when the toner sensor 18 determines that toner remains in the hopper 12 (S17, No), the count in the hopper remaining amount detection counter is cleared (n=0). The process then returns to step S10. This allows the image forming operation to be continued.

In step S17, if the toner sensor 18 still detects that no toner remains in the hopper 12 (S17, yes) even though in step S16, the hopper motor 20 has been driven for the specified time to rotate the stirring paddle 13 in the hopper 12 to evenly level the toner in the hopper 12, the apparatus determines that no toner remains in the toner bottle 10 (S18). For example, the apparatus allows a display unit 23 to show "No Toner" to urge the user to replace the toner bottle 10.

The threshold N for the hopper remaining amount detection counter may be a fixed value or may be variably set depending on the accumulated number of rotation cycles of the toner bottle 10.

Specifically, the basis for this setting is as follows. If the accumulated number (accumulated value) of rotation cycles belongs to the area (a), a large amount of toner remains in the hopper 12 as illustrated in FIG. 5. Hence, even though the toner in the hopper 12 has reached the vicinity of the outlet 11 of the toner bottle 10, the toner sensor 18 fails to detect the toner. Thus, with the threshold N for the hopper remaining amount detection counter set to a predetermined value (for example, 3), the user's clothes and the inside of the apparatus can be prevented from being stained when the toner bottle 10 is pulled out. If the accumulated number of rotation cycles belongs to the area (b), an appropriate amount of toner is expected to remain in the hopper 12 as illustrated in FIG. 6. Thus, with the threshold N for the hopper remaining amount detection counter set to a larger value (for example, 10), the amount of toner in the hopper 12 can be kept optimum. If the accumulated number of rotation cycles belongs to the area (c), only a small amount of toner remains in the hopper 12 as illustrated in FIG. 7. Thus, a long time elapses until the toner in the hopper 12 reaches the toner sensor 18. This may cause the toner sensor to erroneously detect that the hopper is empty. Hence, with the threshold N for the hopper remaining amount detection counter set to a further larger value (for example, 20), the toner sensor can be expected to be prevented from erroneously detecting that the hopper is empty even when only a small amount of toner remains in the toner bottle 10.

Figure 9:
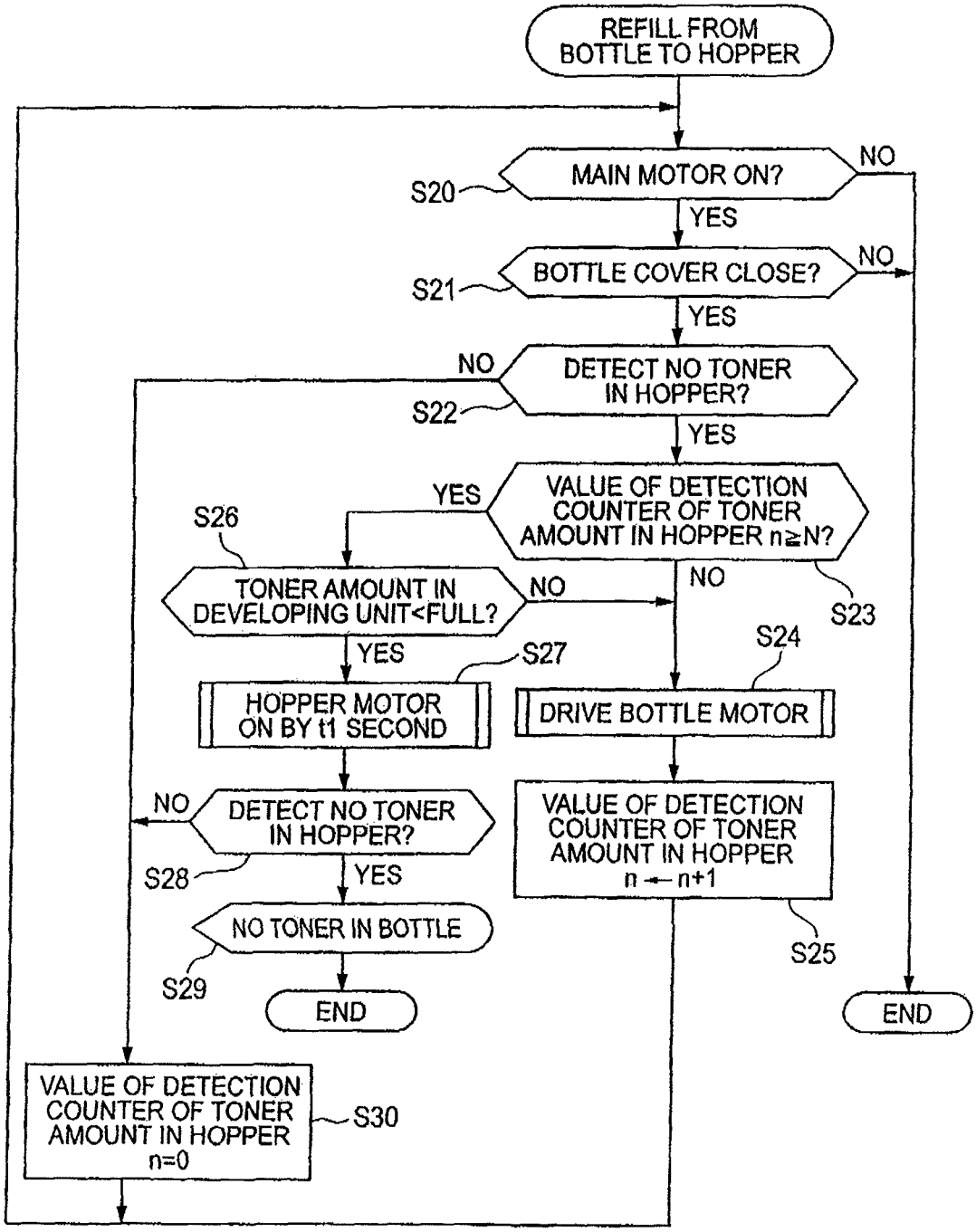
FIG. 9 is a flowchart illustrating a second process example of toner remaining amount control according to the exemplary embodiment of the present invention.

Now, a second process example of toner remaining amount control performed when the hopper is refilled with toner from the toner bottle will be described with reference to FIG. 9. Steps S20 to S25 and S27 to S30 are the same as steps S10 to S19 in FIG. 8. Thus, duplicate descriptions are omitted. FIG. 9 is different from FIG. 8 in that FIG. 9 additionally includes step 26.

That is, when the count in the hopper remaining amount detection counter (n) is equal to or larger than the threshold N, the apparatus avoids immediate rotation of the hopper motor 20 and allows the toner sensor 21 in the developing unit 5 to check the amount of toner remaining in the developing unit 5 in step S26 before the rotation. In a state relatively similar to the initial one, the developing unit 5 may be almost full of toner even though the count in the hopper remaining amount detection counter (n) is equal to or larger than N. In such a state, when the stirring member configured to stir the inside of the hopper is actuated, the conveying unit rotated by the same driving as that applied to the stirring member is rotated. Thus, based on the additional determination in step S26, the conveying unit is inhibited from being temporarily driven with a sufficient amount of toner present in the developing unit 5 (the developing unit 5 is full of toner). Then, the developing unit 5 can be prevented from being further supplied with toner (that is, from being supplied with an excessive amount of toner).

The method for detecting the amount of toner in the developing unit 5 is not particularly limited. For example, the following method is possible. An output from the toner sensor 21 in the developing unit 5 is periodically detected (in the present example, every 0.1 second). When a predetermined number (in the present example, 10) of a given number (in the present example, 15) of detection results indicate that toner remains in the developing unit 5, the apparatus determines that the developing unit 5 is full of toner.

A third process example of toner remaining amount control performed when the hopper is refilled with toner from the toner bottle will be described with reference to FIGS. 10A and 10B.

In the first and second process examples, the number of thresholds N simultaneously utilized for the hopper remaining amount detection counter (n) is one. However, in the present process example, a plurality of thresholds N is provided. This enables variation of the time for which the hopper motor 20 is driven. Furthermore, if the toner sensor 21 detects that toner remains in the hopper in a plurality of different stages as the bottle motor is driven after the toner sensor 21 has detected that no toner remains in the hopper, the amount of toner remaining in the toner bottle can be estimated in the plurality of stages. This process effectively allows the amount of toner remaining in the toner bottle 10 to be determined in a stepwise fashion even if no CRUM is mounted in the toner bottle 10 used. A variation in the remaining amount can be displayed as in the case of a gas gauge. Furthermore, this configuration enables the toner sensor to more accurately detect that the toner bottle is empty.

Figure 10:
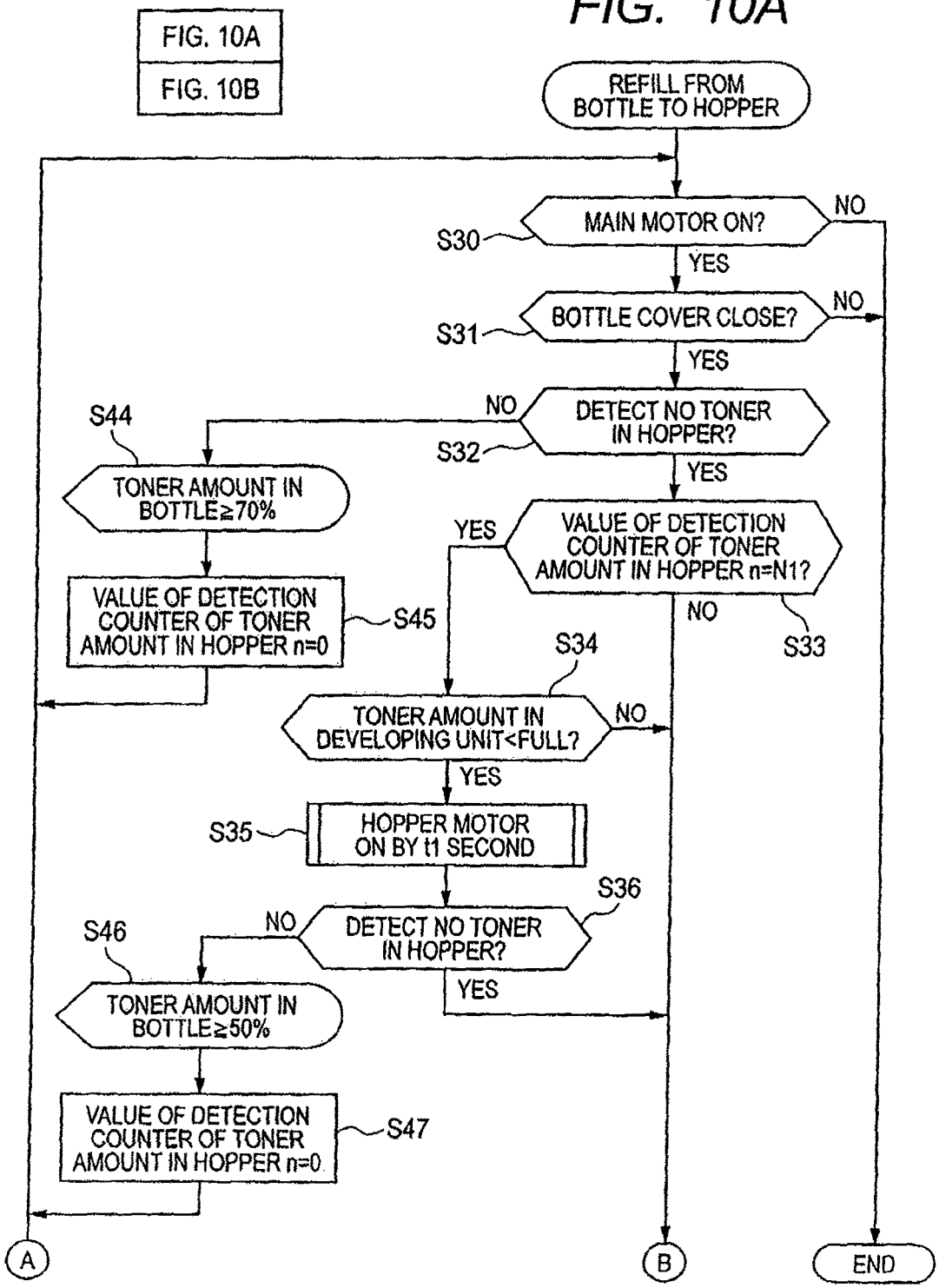
FIG. 10 which is comprised of FIGS. 10A and 10B are flowcharts illustrating a third process example of toner remaining amount control according to the exemplary embodiment of the present invention.
Figure 10B:
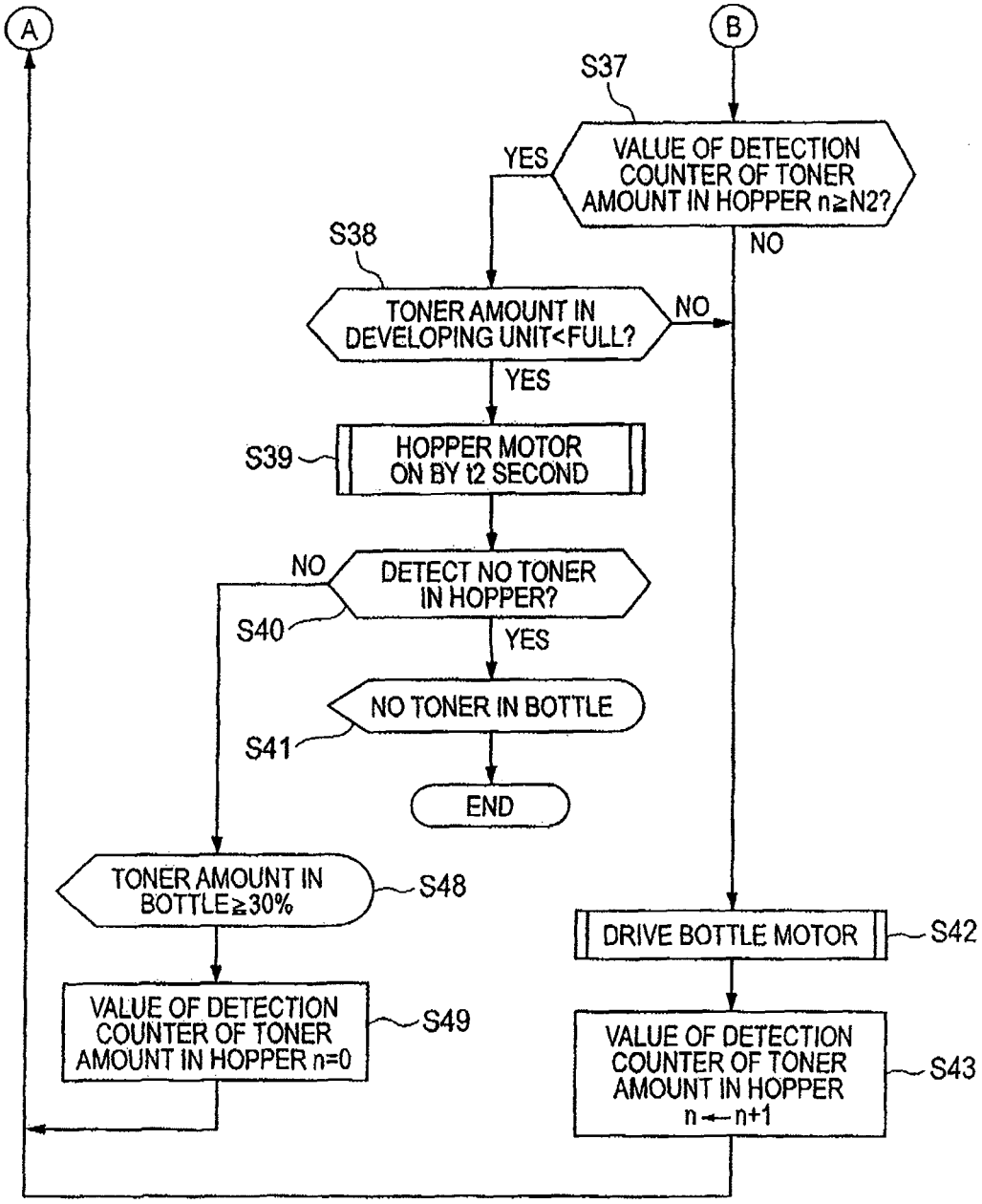

Specifically, the process illustrated in FIGS. 10A and 10B are carried out as follows. First, the apparatus confirms that the main motor configured to drive the photosensitive drum 2 in the image forming apparatus is in the driving state (the main motor is on) (S30, Yes) and that the toner bottle cover (not illustrated in the drawings) is closed (S31, Yes). The apparatus further confirms that the toner sensor 18 in the hopper 12 (that is, the intra-hopper sensor) has detected that no toner remains in the hopper (S32, Yes). The process proceeds to step S33.

In step S32, when the intra-hopper sensor detects that toner remains in the hopper (S32, No), the apparatus determines that at least "70% of the bottle is filled with toner" (S44), and displays this on the display unit 23. Then, the apparatus sets the count in the hopper remaining amount detection counter (n) to 0 (S45). The process then returns to step S30.

In step S32, when the intra-hopper sensor detects that no toner remains in the hopper, the apparatus compares the value (n) in the hopper remaining amount detection counter with the preset threshold N1 (S33). When the count in the hopper remaining amount detection counter (n) reaches a preset first threshold N1 (S33, Yes), the apparatus determines whether or not the developing unit is full of toner as is the case with the second process example (S34). (However, step 834 is not indispensable for the third process example.) When the developing unit is full of toner, the process shifts to step S37 described below. When the developing unit is not full of toner, the hopper motor is driven for t1 seconds (S35). If the intra-hopper sensor still detects that no toner remains in the hopper (S36, Yes), the process shifts to step S37. If the intra-hopper sensor detects that toner remains in the hopper (S36, No), the apparatus determines that at least "50% of the bottle is filled with toner" (S46) and displays this on the display unit 23. Then, the apparatus sets the hopper remaining amount detection counter (n) to 0 (S47). The process then returns to step S30.

In step S37, the apparatus compares the value (n) in the hopper remaining amount detection counter with a preset second threshold N2 (S37). Here, N2 is an integer larger than N1. When the count in the hopper remaining amount detection counter (n) is equal to or larger than the preset threshold N2 (S37, Yes), the apparatus determines whether or not the developing unit is full of toner (S38). (However, step S38 is not indispensable for the third process example.) When the developing unit is full of toner, the process shifts to step S42 described below. When the developing unit is not full of toner, the hopper motor is driven for t2 seconds (S39). Here, t2 may be the same as t1. However, in the present example, t2 is assumed to be larger than t1. Even with the same driving by the bottle motor, the amount of toner discharged from the toner bottle per cycle is expected to be smaller with the threshold N2 than with the threshold N1. Hence, the possibility of successfully detecting that toner remains in the hopper can be enhanced by increasing the time for which the hopper motor is driven, that is, the time for stirring.

If the intra-hopper sensor still detects that no toner remains in the hopper even after the hopper motor has been driven in step S40 (S40, Yes), the apparatus determines that "no toner remains in the bottle" and displays this on the display unit 23. If the intra-hopper sensor detects that toner remains in the hopper (S40, No), the apparatus determines that at least "30% of the bottle is full of toner" (S48), and displays this on the display unit 23. Then, the apparatus sets the count in the hopper remaining amount detection counter (n) to 0 (S49). The process then returns to step S30.

In step S42, the apparatus rotates the bottle motor 15 by one cycle (that is, by a predetermined rotation number or for a predetermined time) to refill the hopper 12 with toner from the toner bottle 10. Then, the apparatus increments the count in the hopper remaining amount. detection counter (n) (by one) (S43). The process then returns to step S30.

The thresholds N1 and N2 are numerical values experimentally or empirically determined based on the predetermined amounts of toner in the bottle (in this example, the amounts corresponding to 50% and 30% of the bottle).

Figure 11:
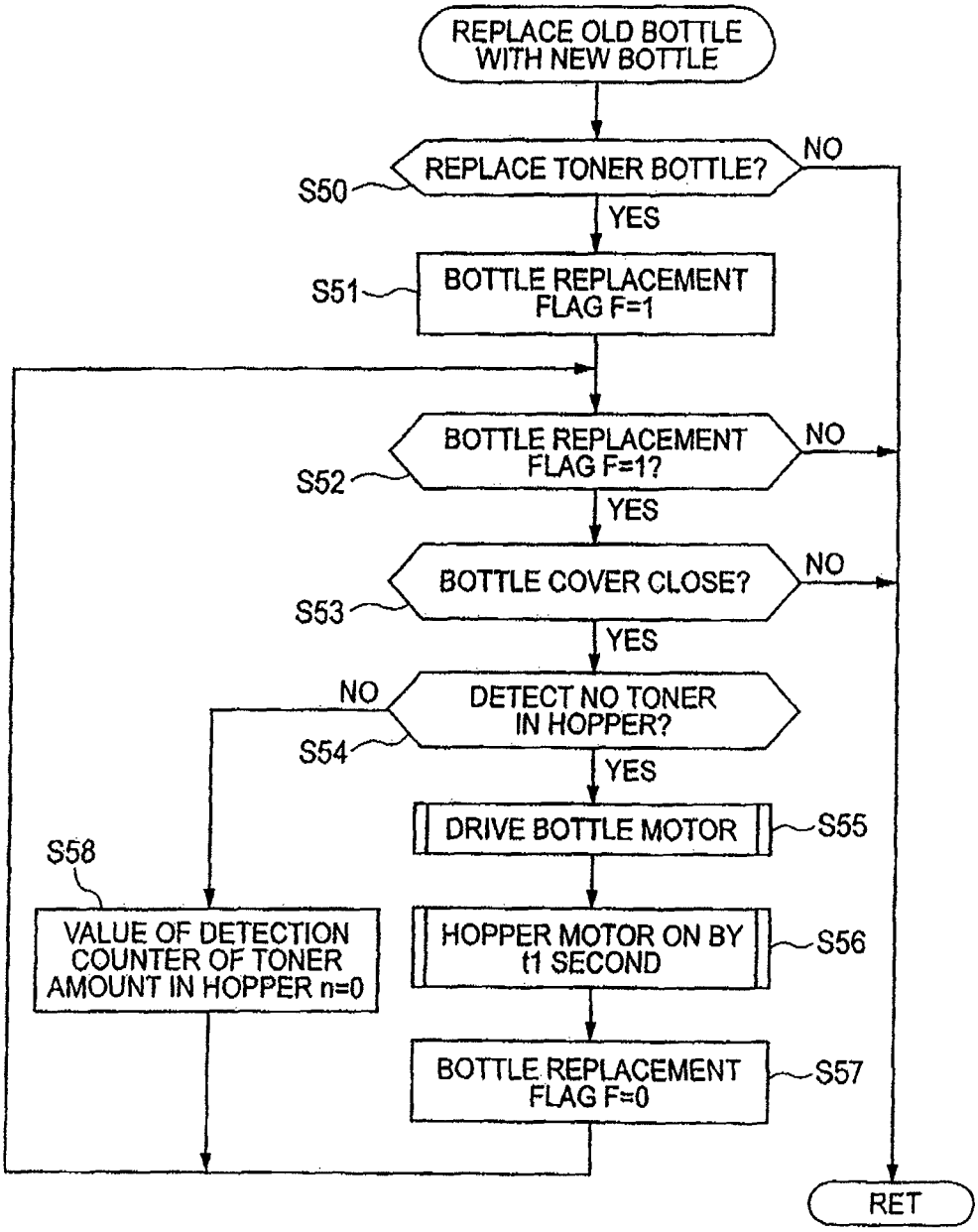
FIG. 11 is a flowchart illustrating a fourth process example of toner remaining amount control according to the exemplary embodiment of the present invention.

Now, a fourth process example of toner remaining amount control performed when the hopper is refilled with toner from the toner bottle will be described with reference to FIG. 11.

If a large amount of toner remains in the toner bottle 10 when the user replaces the toner bottle 10, rotating the toner bottle 10 allows a large amount of toner to be discharged through the outlet 11. Hence, as illustrated in FIG. 5, the toner in the hopper converges on one side of the hopper and reaches the tip of the toner bottle. Thus, when replacement of the toner bottle is detected, the hopper motor 20 is driven to level the toner in the hopper 12.

Specifically, upon detecting the replacement of the toner bottle (S50, Yes), the apparatus sets a bottle replacement flag F to 1 (S51). When failing to detect the replacement of the toner bottle (S50, No), the apparatus shifts to the normal process described above. The replacement of the toner bottle can be detected based on the accumulated number of rotation cycles stored in the CRUM mounted in the toner bottle. In a simplified configuration, the replacement of the toner bottle can be detected based on opening or closing of the toner bottle door in the image forming apparatus.

When the bottle replacement flag is 1 (S52, Yes), the apparatus confirms that the bottle cover is closed (S53, Yes). The apparatus then checks an output from the toner sensor 18 (intra-hopper sensor) in the hopper 12 (S54). When the bottle replacement flag F is set to 0 (S52, No), the apparatus returns to the normal process.

When the intra-hopper sensor detects that no toner remains in the hopper (S54, Yes), the apparatus drives the toner bottle for a given time (S55) and then drives the hopper motor for t1 seconds (S56). Then, the apparatus sets the bottle replacement flag F to 0 (S57). The process then returns to step S52.

In step S54, when the intra-hopper sensor detects that toner remains in the hopper, the apparatus clears the count in the hopper remaining amount detection counter (n) to 0 (S58). The process then returns to step S52.

As described above, according to the fourth process example, the conveying unit is temporarily driven when the hopper is refilled with toner by at least the first rotation of the toner bottle by the unit amount after the replacement of the toner bottle. That is, if the intra-hopper sensor detects that no toner remains in the hopper after the replacement of the toner bottle, when the bottle motor is driven to supply the hopper with toner, the hopper motor is driven to drive the stirring paddle 13 to level the toner in the hopper. This prevents the toner from overflowing the hopper. Furthermore, if the toner bottle is inserted or removed in such a state as described above, the inside of the apparatus and the user's hand or clothes may be stained with the toner attached to the outlet of the toner bottle. However, the present process allows such a problem to be prevented.

The preferred embodiment of the present invention has been described. However, many variations and changes may be made to the above-described embodiment. For example, the present invention does not limit development to a monocomponent scheme or a two-component scheme. The CRUM mounted in the toner bottle 10 can be operated either by radio or by wire. The toner sensor 21 provided in the developing unit 5 may be a sensor configured to detect a toner mixture ratio used for the two-component scheme or a detecting unit configured to determine the amount of remaining toner using a concentration detection patch formed on the transfer belt. Further, in the embodiments described above, the same driving source is used both for the auger (the conveying means) in the conveying path through which a developing unit is refilled with toner and for the stirring paddle (the stirring member). However, the present invention is not limited to such configuration. For example, the present invention can include the configuration, in which each of the auger and the stirring paddle has an individual driving source. Further, the present invention can include the configuration, in which one of the auger and the stirring paddle is driven when another is driven.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-293558, filed Dec. 24, 2009, and No. 2010-278254, filed Dec. 14, 2010 which are hereby incorporated by reference herein in their entirety.

What is claimed is:

1. An image forming apparatus, comprising:

a developing unit which develops an electrostatic latent image formed on an image carrier, using toner;

a toner storing unit in which toner fed from a toner supply unit is stored;

a conveying unit which conveys toner from the toner storing unit to the developing unit;

a toner-in-toner-storing-unit detecting unit which detects a state of toner in the toner storing unit;

a toner-in-developing-unit detecting unit which detects a state of toner in the developing unit; and a determining unit which determines a state of toner in the toner supply unit based on a detection result of the toner-in-toner-storing unit detecting unit, with the determining unit not determining the state of toner in the toner supply unit when the toner-in-developing-unit detecting unit detects a predetermined amount of toner.

2. The image forming apparatus according to claim 1, wherein request for replacement of the toner supply unit is outputted when the determining unit determines that no toner remains in the toner supply unit.

3. The image forming apparatus according to claim 1, further comprising a counting unit which counts a number of executions of a predetermined toner refilling operation after the toner-in-toner-storing-unit detecting unit does not detect a predetermined amount of toner in the toner storing unit, wherein the number of executions of the predetermined toner refilling operation counted by the counting unit is cleared in case the toner-in-toner-storing-unit detecting unit detects the predetermined amount of toner in the toner storing unit before the number of executions of the predetermined toner refilling operation reaches a predetermined threshold.

4. The image forming apparatus according to claim 3, wherein the predetermined threshold is variably set based on an accumulated value obtained by accumulating the number of executions of the predetermined toner refilling operation after the replacement of the toner supply unit.

5. The image forming apparatus according to claim 3, wherein the predetermined threshold includes at least a first threshold and a second threshold, and the amount of toner remaining in the toner supply unit is determined in a plurality of stages based on the value of the number of executions of the predetermined toner refilling operation obtained when the toner-in-toner-storing-unit detecting unit detects a predetermined amount of toner in the toner storing unit as a result of driving of the conveying unit after the toner-in-toner-storing unit detecting unit has not detected the predetermined amount of toner in the toner storing unit.

6. The image forming apparatus according to claim 5, wherein a time for which the conveying unit is driven according to each of at least the first and second thresholds is varied depending on the magnitude of the threshold.

7. The image forming apparatus according to claim 1, further comprising:

a counting unit which counts a number of executions of a predetermined toner refilling operation after the toner-in-toner-storing-unit detecting unit does not detect a predetermined amount of toner in the toner storing unit; and a stirring unit which stirs inside of the toner storing unit, wherein the number of executions of the predetermined toner refilling operation counted by the counting unit is cleared in case the toner-in-toner-storing unit detecting unit detects the predetermined amount of toner in the toner storing unit after the stirring unit has been driven.

8. The image forming apparatus according to claim 1, further comprising a unit which detects that the toner supply unit has been replaced, wherein the conveying unit is driven when the toner storing unit is refilled with toner by at least the first rotation of the toner supply unit by a unit amount after the replacement of the toner supply unit.

9. The image forming apparatus according to claim 1, further comprising:

a toner refilling unit which refills the toner storing unit with the toner from the toner supply unit in case the toner-in-toner-storing-unit detecting unit does not detect a predetermined amount of toner in the toner storing unit; and a stirring unit which stirs inside of the toner storing unit, wherein the toner refilling unit executes a predetermined toner refilling operation without stirring operation by the stirring unit in a case that the toner-in-toner-storing-unit detecting unit does not detect the predetermined amount of toner in the toner storing unit after a toner refilling operation from the toner supply unit to the toner storing unit by the toner refilling unit.

10. The image forming apparatus according to claim 9, wherein the stirring unit operating in conjunction with an operation of the conveying unit executes the stirring operation, and the determining unit determines an amount of toner in the toner supply unit in response to a detection result of the toner-in-toner-storing-unit detecting unit after the stirring operation in a case that the toner-in-toner-storing-unit detecting unit does not detect a predetermined amount of toner in the toner storing unit again after the predetermined toner refilling operation and the amount of toner detected by the toner-in-developing-unit detecting unit is less than a predetermined amount.

11. The image forming apparatus according to claim 9, wherein the stirring unit is not driven, and the determining unit does not determines an amount of toner in the toner supply unit until the amount of toner in the developing unit becomes less than the predetermined amount, in a case that the toner-in-toner-storing-unit detecting unit does not detect a predetermined amount of toner in the toner storing unit after the predetermined toner refilling operation and the amount of toner detected by the toner-in-developing-unit detecting unit is more than the predetermined amount.

12. The image forming apparatus according to claim 1, further comprising a stirring unit which stirs inside of the toner storing unit, wherein the stirring unit is driven based on detection results of the toner-in-developing-unit detecting unit and the toner-in-toner-storing-unit detecting unit.

* * * * *